United States Patent [19]

Weiss et al.

[11] Patent Number: 4,883,052

[45] Date of Patent: Nov. 28, 1989

[54] PROTECTIVE BREATHING MASK

[75] Inventors: Anna-Maria Weiss, Wunsiedel; Klaus Smolik, Gefrees, both of Fed. Rep. of Germany

[73] Assignee: Helsa-Werke Helmut Sandler GmbH & Co. KG, Gefrees, Fed. Rep. of Germany

[21] Appl. No.: 95,816

[22] Filed: Sep. 11, 1987

[30] Foreign Application Priority Data

Jun. 11, 1987 [DE] Fed. Rep. of Germany ..... 3719420

[51] Int. Cl.[4] ..... A62B 7/10

[52] U.S. Cl. ..... 128/205.27; 128/205.29; 128/206.12; 128/206.19; 128/206.21

[58] Field of Search ..... 128/201.25, 205.25, 128/205.27, 205.28, 205.29, 206.12, 206.19, 206.21, 206.22, 206.28, 206.13, 206.14

[56] References Cited

U.S. PATENT DOCUMENTS 3,971,373 7/1976 Braun ..... 128/206.19
4,098,270 7/1978 Dolby ..... 128/206.12
4,215,682 8/1980 Kubik et al. ..... 128/206.19
4,600,002 7/1986 Maryyanek et al. ..... 128/206.19
4,643,182 2/1987 Klein ..... 128/206.19

FOREIGN PATENT DOCUMENTS 3434357 9/1984 Fed. Rep. of Germany .

*Primary Examiner*—Max Hindenburg
*Assistant Examiner*—J. P. Lacyk
*Attorney, Agent, or Firm*—Hoffmann & Baron

[57] ABSTRACT

A multi-layer protective breathing mask adapted to cover the mouth and the nose of a wearer thereof comprises an outer layer, an inner layer and, between the outer and inner layers, a filter element comprising a particle filter and an adsorber filter. The adsorber filter may comprise one or more layers of foam material and the layers of foam material may be of different porosities. The at least one layer of foam material adsorber particles which may preferably be of a plurality of particle sizes.

32 Claims, 1 Drawing Sheet

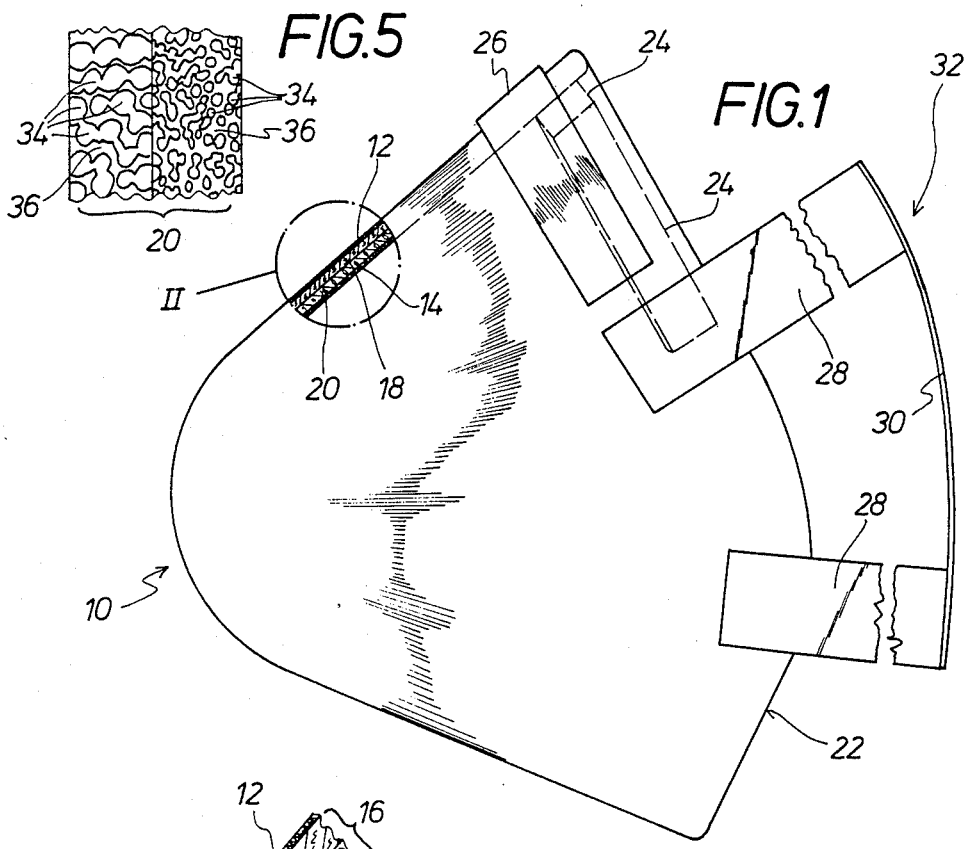
FIG.5
34
34
36
36
20
FIG.1
26
24
32
12
24
II
14
20
18
28
30
28
10
22
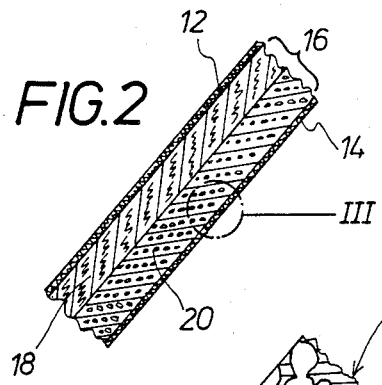
FIG.2
12
16
14
III
20
18
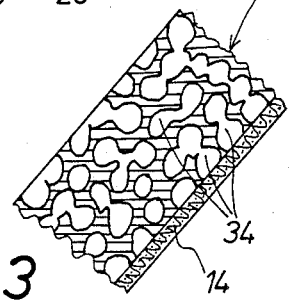
20
34
14
FIG.3
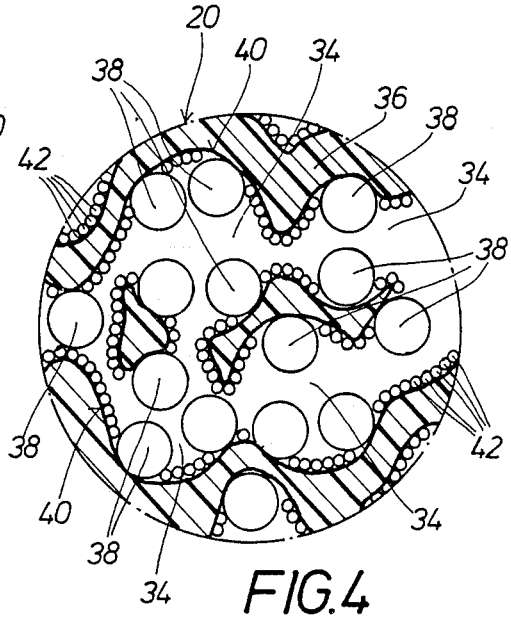
20
40
34
38
36
38
42
34
38
38
42
40
34
38
34
FIG.4

PROTECTIVE BREATHING MASK

BACKGROUND OF THE INVENTION

The invention relates to a protective breathing mask for covering the mouth and nose of a wearer thereof, to provide protection from harmful substances or components that may be present in the air being breathed in.

One form of such a breathing mask is of a multi-layer construction, comprising an outer layer, an inner layer and a filter element therebetween, as disclosed for example in German patent specification No 3 113 828. That mask is used for filtering out contaminating material in particulate form in the air being breathed and for that purpose comprises an outer layer consisting of a hot-deformable plastic material. Likewise the inner layer in that mask may also comprise a hot-deformable plastic material while the filter element between the outer and inner layers is formed by a fibre fleece or non-woven fibre material. The fact that the mask is formed from inner and outer layers of deformable plastic material means that it is relatively expensive to produce. Another disadvantage of that mask is that it takes up a certain amount of space at all times, and cannot be collapsed or folded down to produce a compact item when not in use. Furthermore, that mask is not suitable, or is suitable only to a very limited extent, for removing gaseous noxious substances from the air being breathed in.

A half-mask for filtering out particles and consisting of a soft polymer foam is disclosed in German patent specification No 3 434 357. Although that mask can be folded down and collapsed to provide a compact article when not in use, it is however intended only for filtering out particulate materials and is not suitable for also filtering gaseous materials.

SUMMARY OF THE INVENTION

An object of the present invention is to provide a protective breathing mask which is of a simple construction while being functionally effective.

Another object of the invention is to provide a respiration-protective mask which can be folded down to a compact size.

Still another object of the present invention is to provide a breathing mask which is capable of filtering out noxious substances in particle form as well as noxious substances in gas form.

Yet a further object of the present invention is to provide a breathing filter mask having filter properties which can be adjusted over wide ranges to meet specific situational requirements.

A still further object of the present invention is to provide a protective breathing mask of a composition comprising different materials which can be varied to adapt to specific operating requirements.

In accordance with the present invention, those and other objects are achieved by a protective breathing mask of a multi-layer configuration comprising an outer layer, an inner layer and a filter element disposed therebetween, the filter element comprising a particle filter means and an adsorber filter means.

The particle filter means is preferably arranged on the outward side of the filter element in the mask according to the invention while the adsorber filter means is preferably arranged on the inward side, which is thus towards the face of the wearer of the mask. That arrangement ensures that the adsorber filter is safeguarded against the penetration of particles of noxious substances. The particle filter means and the adsorber filter means are such that the resistance to flow through the mask when the wearer thereof breathes in and out is at an adequately low level.

In a preferred feature of the invention, the particle filter means of the mask according to the invention comprises a layer of electret material. The layer of electret material preferably comprises polycarbonate or polypropylene microfibres. The particles of noxious substance which flow inwardly of the mask through the outer layer thereof are retained at the particle filter by physical forces, in particular electrostatic forces, and are thus prevented from penetrating through the mask into the space therewith, from which the wearer of the mask draws the air and oxygen required for breathing purposes.

The adsorber filter means of the mask according to the invention preferably also includes at least one layer of open-pore foam material provided with adsorber material. The adsorber material may be particles of activated carbon. The adsorber material provides for adsorption or chemical decomposition of the noxious substances which pass into the filter element through the outer layer of the mask. The adsorber material may be impregnated with one or more different metals or metal compounds. The use of one or more suitable metals or metal compounds means that it is possible to vary the catalytic decomposition effect in respect of a very wide range of noxious substances, within wide limits. A similar point also applies in the millitary sphere, in relation to chemical warfare agents. Following Table 1 sets out a number of catalysts and noxious substances or chemical warfare agents which are dealt with by such catalysts:

TABLE 1

| Metal or metal compound | Noxious or like substance |
|---|---|
| copper | hydrocyanic acid, cyanogen choloride |
| zinc | hydrocyanic acid |
| silver | arsenic hydride |
| copper, chromium | mustard gas |
| copper, chromium, silver | Sarin |
| palladium, platinum | carbon monoxide |

The adsorber material of the multi-layer mask according to the invention may be coated with one or more polymers in order to retain moisture or water. Such one or more polymers may be for example polymers from the group consisting of polypropylene, vinyl chloridevinylid ne chloride copolymers, ethylene glycol polymethacrylate, pyroxilin, collagen, acrylic acid-acrylonitrile copolymers, and the like.

In an embodiment of the mask according to the invention, the at least one layer of the adsorber filter which consists of open-pore foam material is provided with adsorber material comprising at least two different particle sizes. The first particles may be particles in the form of balls, grains or granules while the second adsorber particles may be for example in powder or dust form.

In the protective mask according to the invention of the kind set forth in the immediately preceding paragraph the adsorber material may comprise first particles of a particle size which is between 0.1 and 0.9 times the mean pore diameter of the open-pore foam material and the adsorber material may comprise second particles in fine powder form, covering the free pore surfaces which remain between the first adsorber particles. The first larger adsorber particles which are in the form for example of activated carbon balls provide a high storage capacity for noxious gases and vapours. The second smaller adsorber particles provide for good adsorption kinetics.

Suitable selection of the proportion of first larger adsorber particles and the proportion of second particles in fine powder form which cover the free surface of the pores beside the first adsorber particles means that the filter properties of the mask according to the invention can be adjusted as desired within wide limits. That means that it is possible for the filter to provide a high storage capacity, a low level of sensitivity to moisture, a large internal surface area in respect of the activated carbon due to the first larger adsorber particles, and a low pressure drop through the mask, that is to say a low level of resistance to breathing, by virtue of the use of the open-pore foam material. The combined use of first larger adsorber particles and second adsorber particles in fine powder form means that the adsorption kinetics and the storage capacity of the mask can be adjusted as desired. Both the first adsorber particles which are of relatively large volume and also the second smaller adsorber particles are preferably bound on the foam material and into the open pores thereof by means of a binding agent. The binding agent is applied for example by impregnation of the open-pore foam material, at the open pores thereof, before the absorber particles are introduced into the open pores in the foam material.

In another embodiment of the mask according to the invention the adsorber filter may comprise at least two layers of open-pore foam material. Those two layers may comprise layers with first larger adsorber particles and second fine-powder adsorber particles respectively.

In a further embodiment of the mask according to the invention the at least two layers of open-pore foam material may have different levels of porosity. In that arrangement, the layer of the adsorber filter which has a lower level of porosity may be provided with adsorber particles in fine powder form while the layer which has the higher level of porosity may be provided with adsorber particles whose grain size is in the range of from 0.1 to 0.9 times the means diameters of the pores of that layer. That arrangement gives what may be referred to as a progressive filter, namely a filter in which the foam layer with the lower level of porosity is disposed on the side of the mask which is towards the outer layer thereof while the layer of open-pore foam material with the higher level of porosity is disposed on the opposite side of the mask which therefore faces inwardly towards the face of the wearer thereof. By suitable selection of the levels of porosity and the sizes of the adsorber particles, it is possible for the pressure drop or the resistance to the flow of air through the mask as well as the distribution of noxious substances and the storage capacity of the filter arrangement to be controlled and adjusted in virtually any desired manner.

In a preferred feature of the mask according to the invention the adsorber particles in fine powder form occur in the form of an impregnation coating. That coating provides a high level of adsorption kinetics, that is to say the odorous and noxious substances to be removed by the mask are rapidly adsorbed by the particles.

The outer layer of the mask according to the invention is preferably a flame-resistant and/or water-repellent or oil-repellent woven fabric. The fabric may be a cotton or a glass filament fabric. For millitary use of the mask it has been found advantageous for the outer layer to be of an olive green colour. In addition, particularly when the mask is used in the millitary sphere, it is desirable for the outer layer to have appropriate reflective properties in respect of infra-red radiation. The infra-red reflection action should be below 28% at a wavelength of 100 nm. That design configuration of the mask means that the wearer thereof can be protected from infra-red detection. Making the outer layer of the mask flame-resistant gives the mask according to the invention good protection from the effect of flame and fire, and that is advantageous both in regard to use in the millitary sphere and also in regard to use in the civil sphere, for example for use by fire department personnel, when faced with hotel fires and the like. The water-repellent nature of the outer layer which is produced by water-repellent impregnation also protects the mask from moisture and humidity, thereby readily ensuring that the mask has a low pressure drop or a low level of resistance to breathing. Oil-repellent impregnation ensures that any liquid chemical warfare agent which gets on to the mask is repelled by virtue of forming beads or drops thereon, and dropping off the mask, so that such agents are prevented from penetrating into the mask.

In another embodiment of the mask according to the invention the inner layer thereof may be a cotton and/or a polyester fabric, or alternatively a fleece or non-woven fabric material. The individual layers of the mask, namely the outer layer, the inner layer and the filter element therebetween are preferably joined together along the peripheral edge of the mask, which join can be made by sewing the layers together, welding them together or the like. After the individual layers of the mask have been joined together at the edge, the mask can be tided up and finished off with a bevel strip.

In an embodiment of the mask according to the invention, a foam strip is preferably disposed at least along a part of the peripheral edge of the mask at the inward side thereof, to provide a sealing effect. that foam strip ensures that the mask is tightly and closely fitted to the face of a wearer thereof. The foam strip is used in particular in the region of the nose and in the adjoining cheek regions of the face of a user of the mask. The foam strip can be secured by adhesive to the inside of the mask.

The mask according to the invention may also include a flexible stiffening element. The flexible stiffening element may be a metal strip which is sewn on to the mask by means of a strip of the material of the outer layer of the mask. The flexible stiffening element ensures that the mask is fitted in the optimum manner to all possible nose shapes and sizes, thereby further improving the sealing contact between the mask and the face of a wearer thereof.

A preferred embodiment of the mask according to the invention includes an elastic holding element which is fixed by the end portions thereof to the mask. The holding element may comprise for example two rubber bands or strips which are joined together by a connecting portion to provide a H-shaped configuration. The strips extend over the head of the wearer of the mask in such a way that the mask lies snugly and sealingly against the face of the wearer. The strips extend around the back of the head and the nape of the neck of the wearer and are thus comfortably seated and reliably held to the face of the wearer. The holding element is of such a nature that the mask can be quickly fitted and removed, as required.

As already mentioned, the mask according to the invention may be used both in the civil and in the military spheres. It can be worn by solders in the event of unexpected attack with chemical warfare agents as a provisional line of defense, prior to fitting the actual full respiratory mask. Therefore the mask according to the invention can be used to cover for the period of time between the first occurrence of a chemical warfare agent and the moment of fitting a full respiratory mask, also known as the ABC-mask. The mask according to the invention is thus able to ensure in a single manner that, in the event of a surprise attack, solders do not inhale an incapacitating or fatal dose of chemical warfare agent. The fact that the mask according to the invention constitutes a minimal physiological handicap or encumbrance means that it can also be used as a precautionary and preventive measure, while the wearer is asleep. In the civil sphere the mask according to the invention can thus be used in situations involving hotel fires, by fire departments, in industrial operations which involve an ambient atmosphere which is charged with noxious substances, and so forth. As the mask according to the invention is of only light weight, it can also be worn for a prolonged period of time, for a very wide range of different purposes. It also has only a low level of resistance to breathing while further guaranteeing a high degree of speech transmission.

Further objects, features and advantages of the present invention will be apparent from the following description of preferred embodiments thereof.

BRIEF DESCRIPTION OF THE DRAWINGS

FIG. 1 is a side view of a protective breathing mask according to the invention, with the holding elements being shown in broken-away from, FIG. 2 is a view on an enlarged scale of the sectional area indicated by II in FIG. 1, FIG. 3 is a view on a further enlarged scale of the detail indicated at III in FIG. 2, FIG. 4 shows a section from a filter element of the mask of FIGS. 1 through 3, on a greatly enlarged scale, and FIG. 5 shows a section from another embodiment of a filter element of the mask according to the invention.

DESCRIPTION OF PREFERRED EMBODIMENTS

Referring firstly to FIG. 1, shown therein is a perspective side view of a protective breathing mask indicated generally by reference numeral 10. As can be seen from FIG. 2, the mask 10 comprises an outer layer 12, an inner layer 14 and, between the layers 12 and 14, a filter element 16 comprising a particle filter 18 and an adsorber filter 20. The outer layer 12 is made for example from a flame-resistant, water-repellent and oil-repellent cotton or glass filament fabric, or other suitable material. It may be coloured olive green, which is a requirement in particular when the mask 10 is to be used in the millitary sphere.

The inner layer 14 may be of any suitable material such as a non-woven fabric or a cotton and/or polyester fabric. The particle filter 18 is preferably disposed on the side of the filter element 16 which is towards the outer layer 12, and therefore the adsorber filter 20 is preferably arranged on the side of the filter element 16 which is towards the inner layer 14. In that way any particles passing into the mask through the outer layer 12 are retained by the particle filter 18.

The particle filter 18 may be of an electret material, for example in the form of polycarbonate or polypropylene microfibres. The particles are retained in the layer of electret material by electrostatic forces.

The multi-layer structure consisting of the outer layer 12, the filter element 16 and the inner layer 14 of the mask according to the invention is joined together as by sewing or welding along the edge 22 of the mask 10 and tidied up and finished off after having been joined together at the edge 22 by a bevel strip (not shown).

A foam strip as indicated at 24 in FIG. 1 is provided at the part of the edge 22 of the mask 10, which covers the nose and the cheek regions adjoining the nose of the wearer of the mask, at the inward side of the mask. The foam strip 24 is provided for further improving the seal between the mask 10 and the face of the wearer of the mask.

A flexible or bendable stiffening element 26 is provided on the outside of the last-mentioned part of the edge 22 of the mask 10, namely the part of the edge where the foam strip 24 is disposed. The stiffening element 26 may be a deformable metal strip which is sewn in to a strip consisting of the material of the outer layer 12.

Two rubber bands or strips 28 are secured as by sewing by way of their end portions to the body of the mask 10. The two strips 28 extend approximately parallel to each other and are connected together in their middle portion by a connecting element 30, to define a generally H-shaped configuration. The upper strip 28 extends over the back of the head of the wearer of the mask in use thereof while the lower strip 28 extends around the nape of the neck of the wearer. The holding arrangement 32 of the mask 10 which is formed by the strips 28 and the connecting element 30.is such that the mask can be quickly fitted into position and removed.

The provision of the stiffening element 26 means that the mask 10 can be matched to the face of the wearer, particularly in the nose region thereof, so as to adapt to any shape and size of nose, thereby further improving the seal between the mask and the face of the wearer.

Reference will now be made to FIGS. 2 through 4 showing parts of an absorber filter 20 of the mask according to the invention, on different scales, comprising a layer of open-pore foam material which more particularly may be a polyurethane foam. The layer of foam material has a certain level of porosity, that is to say the open pores 34 thereof have a certain mean pore diameter which fluctuates within a relatively narrow range. In comparison therewith, it may be noted at this point that FIG. 5 shows an adsorber filter 20 which has two layers of open-pore foam material, wherein the two layers may have porosities which differ from each other.

Referring now still to FIG. 4, disposed in the open pores 34 of the foam material 36 are adsorber materials in the form of particles of two different sizes. The first particles 34 are of a generally spherical configuration in the illustrated embodiment and such particles may be for example activated carbon balls. The first particles 38 are adhesively fixed to the free surfaces 40 of the pores in the foam material 36.

Second adsorber particles 42 are then adhesively fixed in the same manner to the free pore surfaces 40 which remain between the first adsorber particles 38. For the purposes of fixing the first and second adsorber particles 38 and 42 in the foam material, it is possible for the surface of the pores therein first to be provided with an adhesive layer, whereupon the first and second particles are suitably applied thereto, with the first layer particles being applied prior to the second smaller particles.

In order to produce the layer of adhesive (not shown) on the surfaces of the foam material, the filter material 20 may be dipped into a bath of liquid adhesive until the entire filter material 20 is thoroughly wetted with the adhesive. The filter body 20 is then squeezed out to remove the major part of the adhesive from the open pores 34. The first and second adsorber particles are then applied to the adhesive remaining on the pore surface 40.

The first, relatively large adsorber particles 38 provide a high storage capacity for retaining gaseous noxious substances without substantially increasing the resistance to flow of air through the adsorber filter 20. On the other hand the relatively small second adsorber particles produce a high level of adsorption kinetics, thus providing for rapid adsorption of the noxious and odorous substances to be removed from the air by the filter according to the invention.

In order to increase the contact time of the gaseous noxious substances to be adsorbed, with the adsorber particles of the mask according to the invention, the adsorber filter 20 may not be of a single-layer configuration as shown in FIG. 3, but may comprise two or more layers, as illustrated in FIG. 5. FIG. 5 shows that the adsorber filter 20 comprises a layer of foam material 36 with a high degree of porosity, that is to say, with open pores of large mean diameter, and a further layer of foam material 36 with a low degree of porosity, that is to say with open pores 34 of small mean diameter. That construction provides what may be referred to as a progressive filter in which the comparatively large open pores 34 which are at the left-hand side in FIG. 5 are provided with relatively large first adsorber particles while the comparatively small pores 34 of the foam material 36 at the right in FIG. 5 are provided with second adsorber particles which are in the form of powder or dust or small balls, with the second adsorber particles being of a diameter of between 0.05 and 1 μm.

It will be appreciated that it is also possible for the layer of foam material 36 with the large open pores 34 to be provided not just with comparatively large adsorber particles, but, as shown in FIG. 4, to have a combination of first large adsorber particles 38 and second small adsorber particles 42. Suitable selection in respect of pore size and adsorber particle sizes means that the pressure drop through the mask 10 or the resistance to the flow of air therethrough, as well as the distribution of noxious substances therein and the storage capacity thereof, can be controlled in virtually any desired manner.

A preferred construction of the mask 10 according to the invention is as follows:

The outer layer 12 comprises a cotton-glass filament fabric which is made flame-resistant and water-repellent.

By virtue of a mechanical filtration effect the particle filter 18 retains substances and materials which float in the ambient air, to prevent such from reaching the wearer of the mask. The particle filter 18 is in the form of a triple-layer composite structure comprising a carrier fleece or non-woven material, a middle layer of polycarbonate microfibres and a cover fleece or non-woven material. The advantage of that electret filter in comparison with conventional particle filters is on the one hand that i has an enhanced separation capacity, particularly in relation to particles in the size range of from 0.1 to 2 μm, which can pass into the lungs, while on the other hand it provides a lower pressure drop with a comparable level of effectiveness.

The adsorber filter 20 employed in the construction being discussed herein is a combination filter comprising a pre-filter layer of open-cell or reticulate polyurethane foam with a pore size of 15 to 100 pores per inch, being 3 mm in thickness. The polyurethane foam is impregnated with a paste consisting of the following components:

- 20 to 30 parts by weight of highly active activated carbon in powder form, coated with one or more catalysts,
- 40 to 65 parts by weight of water,
- 10 to 20 parts by weight of binding agent, and
- 5 to 10 parts by weight of thickening agent.

That pre-filter layer serves as a chemisorption filter.

The operation of impregnating the polyurethane foam with the activated carbon paste may be carried out in the following manner:

(a) application of the medium-viscosity paste by foularding (sizing or impregnating),
(b) spraying on the paste, or
(c) padding the paste on to the foam on both sides.

The combination filter further comprises one or two gas filter layers of open-cell or reticulate polyurethane foam with a pore size of 15 to 25 pores per inch and a material thickness of from 3 to 6 mm. That polyurethane foam is impregnated with a binding agent and in a subsequent operation spheroidal activated carbon particles 38 are fixed to the polyurethane foam 36, in the configuration shown for example in FIG. 4. That gas filter layer has a high storage capacity for storing noxious substances adsorbed thereby.

The degree of hardness of the polyurethane foam can be adjusted by pre-impregnation with a suitable binding agent. A defined application of binding agent may be effected by spraying, foularding, padding or by means of a roller process.

There are various alternative ways of coating the polyurethane foam with the activated carbon balls or particles 38 (as referenced in FIG. 4):

(a) electrostatic covering,
(b) defined scattering of the particles on the foam material, with a slight excess,
(c) projecting the particles on to the foam material in a defined manner, or
(d) passing the material through a bath of the activated carbon balls.

The activated carbon in powder form is a highly active powder carbon with an internal surface area of over 1000 $m^2/g$ (with a high proportion of macropores). The powder carbon is finely crushed so that 80% of the carbon is smaller than 40 μm in size. The powder carbon may be impregnated with metal salts such as copper or chromium for dealing specifically with certain noxious substances.

As carrier means for the impregnating materials, it is also possible to use zeolites which may be employed instead of activated carbon or blended with activated carbon.

The internal surface area of the activated carbon balls 38 is 600 to 1400 $m^2/g$ (with a high proportion of mesopores). The diameter of the balls may be from 0.1 to 0.9 mm, with an optimum relationship betwen adsorber contact and adsorption kinetics being achieved when using carbon balls of a diameter of 0.4 mm. The carbon balls may be impregnated with one or more metals or metal compounds, to deal with specific gaseous noxious substances.

The following may be used as binding agent:

modified acrylates
polyurethanes
silicone rubber
polyvinylidenes
polyvinylchloride
polyamide
polyester granules or powder.

A white viscose non-woven fabric or a black polyamide charmeuse material may be used as the inner layer 14. Viscose non-woven fabrics or fleeces are skin-compatible and, in regard to the filter effect, afford particular advantages due to the high capacity thereof for absorbing moisture. The microscopic effect of the viscose fabric on the one hand produces an additional filtering action due to the moist layer when breathing in while on the other hand the gas filter is protected from moisture when the wearer of the mask breather out. As the adsorption capcity of the filter already experiences a markedly adverse effect, as from about a 60% relative humidity level in the respiration air, the use of a viscose non-woven fabric considerably increases the operating life of the mask 10.

The outer layer 12, the particle filter 18, the adsorber filter 20 and the inner layer 14 are welded or sewn together on both sides using single seams. In that connection the mask 10 should have the minimum number of seams and joints, to provide the chemical protective effect. The edge 22 of the mask 10 is then tidied up over all the layers of material, with abevelled strip. The gas filter layer which is coated with activated carbon particles as indicated at 38 in FIG. 4 is preferably loose in the sandwich-like structure of the mask 10, being fixed only at the edge thereof.

As indicated above, a polyurethane foam strip 24 which runs out at the sides is secured directly to the edge 22, for example by adhesive means, on the upper part of the mask, to provide a seal at the edge 22. It is also possible to use a beaded bar seal which extends around the mask, with foam cords, to provide the edge sealing arrangement. Other possible ways of producing the seal are as follows:

sewing a sealing lip member of polyurethane foam to the trim or edging strip for tidying up the edge of the mask, or welding around the edge 22 of the mask, to provide a beaded edge configuration.

The holding arrangement 32 for holding the mask 10 in position on the head of the wearer is formed by the above-mentioned rubber strips 28 which are for example sewn to the mask 10 and which are connected by the element 30 which comprises for example synthetic leather, behind the head of the wearer. The holding arrangement 32 is such that the mask 10 can be quickly fitted into position and removed.

The rubber strips 28 may also be secured to the body of the mask 10 in ways other than sewing, for example by welding or riveting. The length of the rubber strips 28 may be altered as required for example by the provision of press studs or another suitable form of attachment device such as that consisting of a strip bearing small loops and a further strip bearing small hooks adapted to engage the loops to hold the strip together to give a closure action. The holding arrangement 32 with the rubber strips 28 may also be of a similar nature to the holding arrangement for example of a pair of diving goggles.

It will be appreciated that the foregoing embodiments of the invention have been described solely by way of example of the teachings of the invention and that various modifications and alterations may be made therein without thereby departing from the spirit and scope of the invention.

Cross-reference to a co-pending application: attention is directed to co-pending patent application U.S. Application Ser. No. 95,820 now U.S. Pat. No. 4,800,190 entitled "Process for the production of a filter material" and filed simultaneously herewith.

What is claimed is:

1. A multi-layer protective breathing mask for covering the mouth and the nose of a wearer comprising an outer layer, an inner layer and a filter element between the outer and inner layers, the filter element comprising a particle filter which comprises a layer of electret material, and an adsorber filter which comprises at least one layer of open-pore foam material provided with at least two different particle sizes of adsorber material, said particle filter being arranged at the outward side of said filter element and said adsorber filter being arranged at the inward side of said filter element.

2. A mask as set forth in claim 1 wherein said electret material comprises polycarbonate microfibres.

3. A mask as set forth in claim 1 wherein said electret material comprises polypropylene microfibres.

4. A mask as set forth in claim 1 wherein said adsorber material comprises activated carbon particles.

5. A mask as set forth in claim 1 wherein said adsorber material is coated with a polymer for retaining water and moisture.

6. A mask as set forth in claim 1 wherein said adsorber material is impregnated with at least one catalyst.

7. A mask as set forth in claim 6 wherein said at least one catalyst is adapted to destroy noxious substances.

8. A mask as set forth in claim 6 wherein said at least one catalyst is adapted to destroy odorous substances.

9. A mask as set forth in claim 6 wherein said at least one catalyst comprises a metal.

10. A mask as set forth in claim 6 wherein said at least one catalyst comprises a metal compound.

11. A mask as set forth in claim 1 wherein said adsorber material comprises first particles of a particle size of from about 0.1 times to about 0.9 times the mean pore diameter of the open-pore foam material and second particles in fine powder form, wherein said second particles are on the free pore surface remaining beside the first adsorber particles.

12. A mask as set forth in claim 1 wherein said adsorber filter means comprises at least two layers of open-pore foam material wherein each size of particles of said two different particle sizes are in separate layers.

13. A mask as set forth in claim 12 wherein said at least two layers of open-pore foam material are of different porosities.

14. A mask as set forth in claim 13 wherein the layer of the adsorber filter means which is of the smaller porosity is provided with adsorber particles in fine powder form and the layer of the adsorber filter means with the larger porosity is provided with adsorber particles whose size is in a range of from about 0.1 times to about 0.9 times the mean pore diameter of said layer.

15. A mask as set forth in claim 14 wherein said fine-powder adsorber particles are present in the form of an impregnating coating.

16. A mask as set forth in claim 1 wherein said outer layer is a woven fabric.

17. A mask as set forth in claim 16 wherein said fabric has been treated to impart a flame-resistant property.

18. A mask as set forth in claim 16 wherein said fabric has been treated to impart a water-repellant property.

19. A mask as set forth in claim 16 wherein said fabric has an oil repellant property.

20. A mask as set forth in claim 16 wherein said outer layer comprises a cotton fabric.

21. A mask as set forth in claim 16 wherein said outer layer comprises a glass filament fabric.

22. A mask as set forth in claim 1 wherein said outer layer has been imparted with reflective properties in respect of visible light.

23. A mask as set forth in claim 1 wherein said outer layer has been imparted with reflective properties in respect of infra-red radiation.

24. A mask as set forth in claim 1 wherein said inner layer is a skin-compatible fabric.

25. A mask as set forth in claim 24 wherein said fabric is a woven fabric.

26. A mask as set forth in claim 24 wherein said fabric is a knitted fabric.

27. A mask as set forth in claim 24 wherein said fabric is a nonwoven fleece fabric.

28. A mask as set forth in claim 1 and further including a sealing strip portion arranged at least along a part of the peripheral edge of the mask at the inward side thereof to provide a seal between the mask and the face of a person wearing same.

29. A mask as set forth in claim 28 wherein said sealing strip portion comprises foam material.

30. A mask as set forth in claim 1 and further including a bendable stiffening means at the portion of the mask which is adapted to cover the nose and the cheek region adjoining the nose of the wearer of the mask.

31. A mask as set forth in claim 1 and further including an elastic holding means having end portions secured to the body of said mask.

32. A mask as set forth in claim 31 wherein said holding means comprises first and second rubber strips and a connecting portion interconnecting same to provide a generally H-shaped configuration of said holding means.

* * * * *